US005922260A

United States Patent [19]

Rossi

[11] Patent Number: 5,922,260

[45] Date of Patent: Jul. 13, 1999

[54] METHOD OF MAKING DIE SET FOR FORMING CERAMIC TILES

[76] Inventor: Pellegrino Rossi, Via D. Alighieri No. 1 - 42019, Scandiano (Reggio Emilia), Italy

[21] Appl. No.: 09/017,441

[22] Filed: Feb. 2, 1998

Related U.S. Application Data

[63] Continuation-in-part of application No. 08/408,402, Mar. 22, 1995, Pat. No. 5,714,177.

[51] Int. Cl.[6] ..... B28B 3/00; B28B 7/38

[52] U.S. Cl. ..... 264/109; 29/458; 264/680; 264/219

[58] Field of Search ..... 264/680, 109, 264/219; 29/458; 425/195, 193, 406; 249/112

[56] References Cited

U.S. PATENT DOCUMENTS

| | | | |
|---|---|---|---|
| 2,763,049 | 9/1956 | Peebles | 264/680 |
| 3,627,861 | 12/1971 | Timke | 264/680 |
| 4,350,486 | 9/1982 | Croseck et al. | 249/134 |
| 4,427,352 | 1/1984 | DeSantis et al. | 425/78 |
| 4,522,768 | 6/1985 | Roscrow | 249/134 |

FOREIGN PATENT DOCUMENTS 56-124237 9/1981 Japan .

*Primary Examiner*—James Derrington
*Attorney, Agent, or Firm*—Zachary T. Wobensmith, III

[57] ABSTRACT

The invention relates to a method of making a die set for the manufacture of specially shaped ceramic tile, and the tiles formed thereby. A main component of the die set is a lower punch made of rigid material, on whose upper surface a profile is cut which is suitably shaped to form the front face of the ceramic tile, including the contoured side. The punch has a complete, continuous coating of synthetic resin or rubber bonded to it, with the punch's upper surface defining the form of the front face of the ceramic tile. The coating is continuous and covers the lateral portion of the profile that forms the shaped side, and continues on the upper most part with a horizontal edge which is turned externally with respect to the profile, upon the upper lateral surface of the body of the punch; furthermore a rigid body is fixed above the upper lateral surface, which acts to clamps the horizontal extension of the coating against the lateral surface.

5 Claims, 2 Drawing Sheets

METHOD OF MAKING DIE SET FOR FORMING CERAMIC TILES

CROSS REFERENCE TO RELATED APPLICATION

This application is a continuation in part of my prior application Ser. No. 08/408,402 filed Mar. 22, 1995, now U.S. Pat. No. 5,714,177 entitled: DIE SET FOR FOMING CERAMIC TILES.

BACKGROUND OF THE INVENTION

1. Field of the Invention

This invention relates to a method of making an improved die set for forming ceramic tiles and the tiles formed thereby, which die set is of the type which includes a punch having the profile of the tile edge, and with a coating of synthetic resin or rubber bonded thereto.

2. Description of the Prior Art

The use of a die set for the forming of ceramic tiles in which one or more sides of the tiles are shaped in the so-called "Bullnose" or "Step Edge" manner is described; which means that the edge, viewed in cross section, has its profile described by an arc that connects with the upper face plane and the lower back plane of the tile, and whose radius develops through an angle of about 90°, in the case of the "Bullnose", or an arc whose radius is developed through an angle notably greater than 90°, in the case of the "Step Edge". The shaped side as configured is viewed as the front face of the tile, and the tile is typically selected to form a step or structural similar edging element.

Shaped tiles are disclosed in the publication ANSI A137-1-1988, published by The Tile Council of America, Inc., P.O. Box 326, Princeton, N.J. 08542-0326, The U.S. Pat. Nos. 4,522,768 to Roscrow; 4,350,486 to Croseck, et al., No. 5,330,346 to Scardovi, and the Japanese Patent No. 56-124237 describe various structures, but do not disclose my invention.

The die set incorporates two punches, one upper and one lower, and a matrix. The ceramic material is held in place by the matrix and the lower punch, and is compacted as the upper punch is driven towards the lower punch to compress the material in the cavity described by the matrix. The two punches shape the ceramic material into a tile in manner which forms the front face of the tile, including the shaped edge (or edges), and respectively, the ulterior face (so-called "trademark side") of the tile.

A technical problem present in prior art die sets is that as the upper and lower punches are mated together to form the ceramic tile, the metal of the edge of the upper punch, and the coating on the portion of the lower punch which forms the desired shaped edge side, approach each other to closely to be exactly controlled. In fact the large pressing action needed to form the ceramic tile tends to create a tangential force that forces the edge of the upper punch closer to the shaped lateral portion of the lower punch. It has been suggested that the lower punch cutout be coated with a layer of material to reduce the tendency of the tile residue to stick to the punch. However, the end point of the coating which was vulcanized onto the lower punch is very easily damaged by the "paring" action of the edge of the upper punch, which results from its close proximity.

In order to overcome this drawback existing technology has often chosen to create a lower punch from which a certain amount of coating is intentionally left off the lateral portion of the punch, and the metal is left exposed to form the desired shape. This action creates another disadvantage, that is to say that the aesthetic appearance of the surface of the tile is not uniform and is more coarse where the coating is present than where the polished metal is in contact with the surface of the tile being formed. Such non-uniformity in finished facial quality is evident for glazed products as well as that of unglazed tile. Furthermore, where the coating is lacking the material residues stick, and the necessity of cleaning becomes relatively frequent and consequently greater machine downtime occurs.

The present invention provides for completely coating the lower punch area which forms the tile edge with a layer of synthetic resin or of rubber, which has the property of being substantially self cleaning during operation. The coating is effective in preventing any rapid build up of unwanted material residues which would rapidly adhere to the uncoated punch. Accordingly the machine does not have to be stopped and residues from the tile material on the punch cleaned, and therefore no production time is lost.

SUMMARY OF THE INVENTION

The principal object of the invention is to overcome the disadvantages of the prior art by providing a die set for forming ceramic tiles wherein a continuous layer of material is provided on the lateral portion of the punch which forms the profile of the tile's edge, so that no residue sticks thereto, and no paring of the coating occurs.

DESCRIPTION OF THE DRAWINGS

The nature and characteristic features of the invention will be more readily understood from the following description taken in connection with the accompanying drawings forming part hereof in which.

It should, of course, be understood that the description and drawings herein are merely illustrative and that various modifications and changes can be made in the structures disclosed without departing from the spirit of the invention.

Like numerals refer to like parts throughout the several views.

DESCRIPTION OF THE PREFERRED EMBODIMENTS

When referring to the preferred embodiments, certain terminology will be utilized for the sake of clarity. Use of such terminology is intended to encompass not only the described embodiment, but also technical equivalents which operate and function in substantially the same way to bring about the same result.

Figure 1:
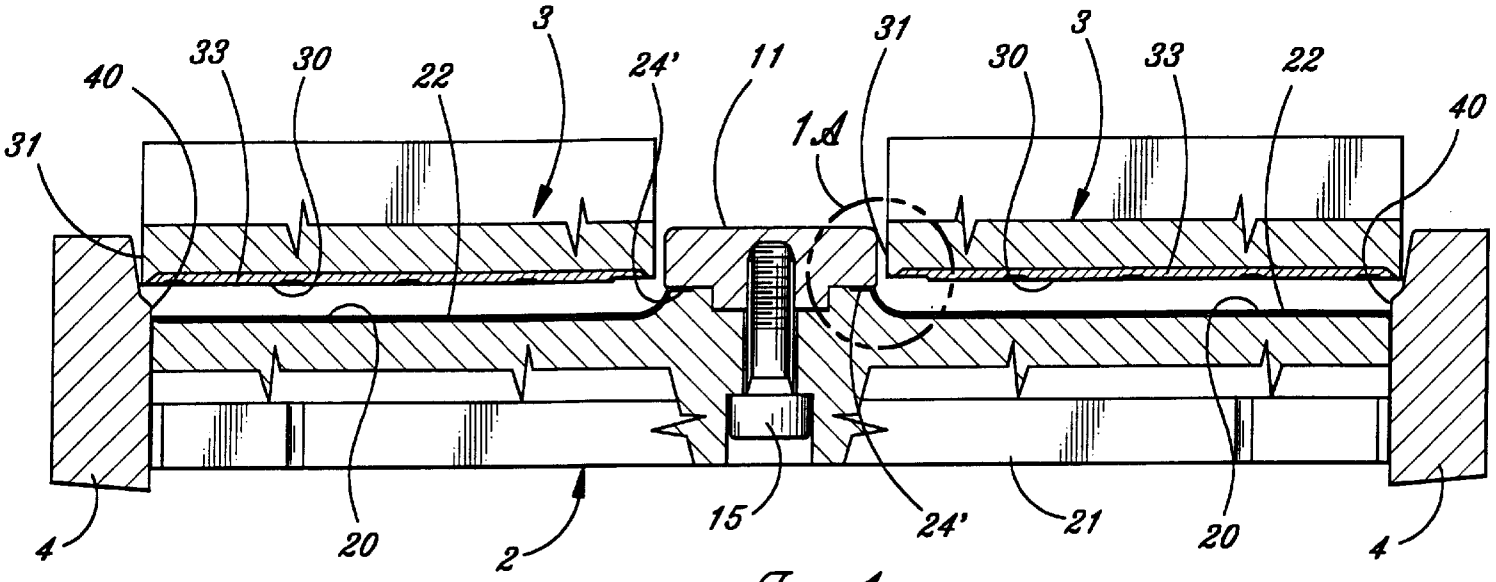
FIG. 1 is a vertical cross sectional view of a multiple die set punch which provides for forming two tiles with a "Bullnose" edge, FIG. 1.A is a detail enlargement of a portion of FIG. 1.
Figure 1D:
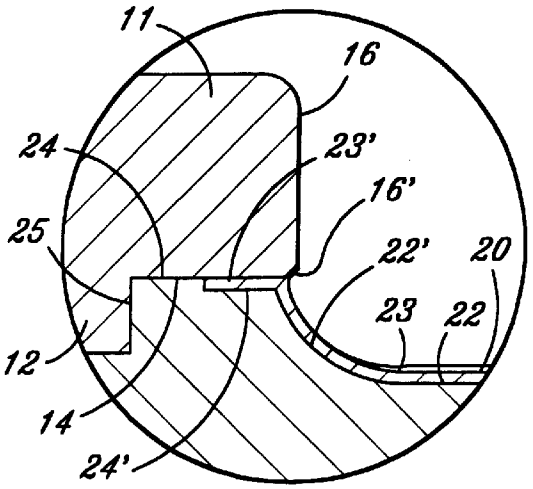
Figure 2:
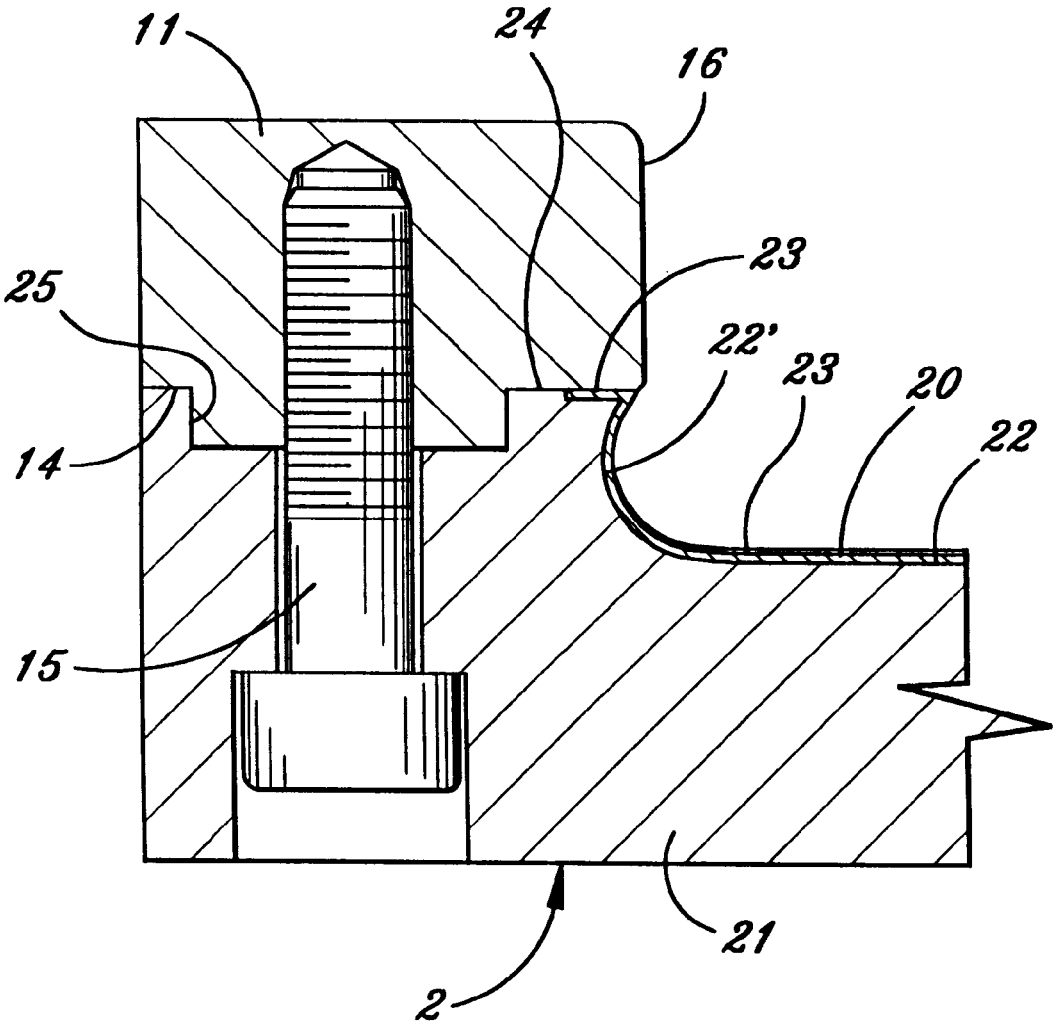
FIG. 2 is a detailed enlargement similar to FIG. 1.A, which illustrates a punch designed for the formation of two tiles with a "Step edge".

Referring now more particularly to the drawings and FIGS. 1 and 2 thereof, the die set of the invention includes a lower punch 2 and an upper punch 3, which are designed to come together within the cavity of a matrix 4. The upper face of the punch 2 and the lower face of the upper punch 3 both define the desired form of the finished tile, with one face forming the front, and the other the ulterior of a tile. In the die set illustrated in the FIGS. 1, 1A and 2, the punch 2 that forms the front face of the tile is under the punch 3, and the description that follows is based on this geometric disposition.

The geometric disposition of the components of the die set could be different, if desired by setting the punch 2 above the punch 3.

The die set can be of the type for the formation of multiple tiles, as illustrated in FIG. 1, which illustrates two upper punches 3, a lower punch 2 with two forming surfaces and a multiple matrix 4, or it could be of the individual type.

In the present invention the punch 2 used to shape the front face of the tile is of either the desired shaped edges (i.e. "Bullnose" or "Step Edge"), and both edges are illustrated in the figures presented of the lower punch 2.

The punch 2 includes a body 21 of rigid material, preferably of steel, whose upper surface has been machined to form a shaped profile or impression 22 designed to produce the front face of a tile. The shape to be achieved is illustrated in FIGS. 1 and 1A, and is described by the impression 22 having a horizontal plane for a majority of the surface, and has a lateral portion 22', which is an arc which starts tangent to the plane of 22 and ends with the radius of the arc describing an arc of 90°. To achieve the shape illustrated in FIG. 2, the arc's radius describes an angle greater than 90°, ending where the tangent of the arc is inclined with respect to the vertical.

The impression 22 is covered completely with a coating or layer 23 which is composed of either synthetic resin or rubber and has the property of being self cleaning. The layer 23 can be either vulcanized or glued onto the impression 22, and its upper surface defines the forming surface 20, which forms the front face of the tile.

The upper punch 3 preferably includes a coating 33 of synthetic resin or rubber, having the property of being self cleaning, and whose lower surface defines the forming surface 30, which forms the back side of the tile.

The matrix 4 has inner faces 40, which are substantially vertical, bound the cavity of the die set, and form the vertical sides of the tile, and these sides are different as to the lateral or multiple lateral sides that the lateral portion 22' describes.

The invention requires that the coating 23 be continuous and completely cover impression 22 as well as the lateral portion 22', all of which form the tile front face with it's special shape; the layer 23 continues further than the uppermost edge of the lateral portion 22', and the continuation of the coating is described by coating edge 23', where the coating is turned toward the exterior with respect to the impression 22, and occupies a cutout 24' on the lateral surface 24 of the body 21 of the punch 2. A specific recess is cut into the surface 24 to the size of the thickness and length of the coating edge 23'.

Above the surface 24, a clamping part 11 is placed that clamps the coating edge 23' against the surface 24 of the body 21, making the coating edge 23' flush with the body 21 of the punch 2.

In detail, the clamping part 11 and lower surface 14 mate with the lateral surface 24 and with the upper surface of the coating edge 23', furthermore the clamping part 11 is designed to have a protruding portion 12 on its lower side that insures the alignment of the clamping part 11. The protruding portion of 12 is mated to the surface 25.

The coupling between the portion 12 and the notch 25 allows for exact positioning of the clamping part 11 onto the body 21, and therefore this arrangement between the clamping part 11 and the body 21 is retained by more than just the screws 15.

With the shape of the tile edge to be formed as illustrated in FIG. 1, where the forming is of a multiple type, the geometric disposition discloses that on punch 21 there are two impressions 22 arranged side by side symmetrically about the vertical center of the plane; furthermore the lateral portions 22' of the impressions 22 are arranged symmetrically adjoining each other in the center of the punch 2; which allows for the clamping part 11 to be positioned in the center area of the body 21, which simultaneously fixes the edge 23' of the coating 23 for both punch forming surfaces.

Besides forming the particular shape of interest in the lateral portion of the impression 22', which is completely covered by coating 23, this coating is affixed in an extremely effective way to the body of the punch 21, in particular, the end of the upper edge 23' is not exposed to the detrimental tangential thrusts of the edge of the upper punch 3 during the pressing stage of formation of the tile, which is due to the shape as noted in the arguments above, and do not tend to detach the coating through a "paring" action.

According to a preferred shape, but not exclusively for its achievement, illustrated in the figures, the clamping part 11 has a vertical face 16 which acts as a continuation of the coating 23 that covers the lateral portion 22' of the impression 22. The vertical face 16 defines one face of the cavity of the mould, which cavity accepts the ceramic material to be compacted to ultimately form the finished ceramic tile shape when it is pressed to its final dimensions, and this face 16 passes the edge 31 of the upper punch 3 with a tight tolerance during the pressing phase of formation.

Additionally, the face 16, as seen in the cross sectional views, has a profile which includes a bevelled edge 16', which acts to place a corresponding bevel between the ulterior face of the finished tile and the outer edge of the shaped edge. This bevelled edge 16' is designed to shape the ulterior side of the finished tile edge, and its presence allows a discrete tolerance in the run of the upper punch with respect to the lower punch, which is fixed in position during pressing, and therefore the final position arrived at by the upper punch during the pressing determines the thickness of the tile. Without the bevelled edge 16', the shaped, rounded edge of the tile will become eroded in appearance. In addition, the offset provided by the bevel 16' provides greater protection against the "paring" action of the upper punch on the lower punch's coated shaped edge should the thickness tolerance become exhausted during the press stroke.

It will thus be seen that apparatus has been provided which achieves the requirements of the invention.

I claim:

1. A method of making a die set for forming ceramic tiles, having at least one shaped side, with said die set having at least an upper punch (3) and a lower punch (2), said lower punch (2) being of a "Bullnose" or "Step Edge" configuration, comprising the steps of machining the upper surface of said lower punch (2) to form a shaped impression (22), inclusive of a horizontal cutout (24');

applying a layer or coating (23) thereon of synthetic resin or rubber that completely covers the impression (22), and cutout (24'), and whose upper surface defines the surface form of the front face of the ceramic tile;

applying a coating (33) to the upper punch (3) and whose lower surface defines a forming surface (30) to form the backside of the tile; said layer or coating (23) is continuous and completely covers the lateral portion (22') of impression (22) that forms a general shape, which continues on the upper most part, and into the cutout (24') the layer 23 having a horizontal edge (23')

turned toward the exterior with respect to the impression (22) in the cutout (24'), on an upper lateral surface (24) of the body (21) of the punch (2), and providing a rigid part (11), in contact with the upper lateral (24) of the body (21) of the punch, to clamp the horizontal edge (23') in the cutout (24') against the surface (24) of the body (21) of the punch.

2. The method of claim 1, comprising the additional steps of machining additional shaped impressions (22) in the single body (21) of punch (2), said impressions being arranged side-by-side symmetrical to the vertical center of the plane, with both of the lateral portions (22') of each mold arranged in the center of the punch (2), and placing said clamping part (11) in the center of the body (21) of the punch (3), that simultaneously is used to affix both horizontal edges (23') of the continuous layer or coating (23) for both shapes to the punch.

3. The method of claim 1, comprising the steps of machining a vertical plane face (16) in said clamping part (11) to form a substantial continuation of the portion of layer (23) that covers it, and providing a tight tolerance to which the edge of the upper punch (3) is held during pressing, by said lateral portion (22') of said impression part (11) defining a face of the cavity.

4. The method of claim 3, comprising the additional step of providing a lower bevelled edge (16') in said plane face (16) of said clamping part (11) to place a corresponding notch in the finished form of the ceramic tile between the ulterior face of the tile and the outermost edge of the shaped side.

5. A method of forming ceramic tiles in a die set, having at least one shaped side, with at least an upper punch (3) and a lower punch (2), said lower punch (2) being of a "Bullnose" or "Step Edge" configuration (21'), whose upper surface has been machined to form a shaped impression (22), inclusive of a horizontal cutout (24') and with a layer or coating (23) thereon of synthetic resin or rubber that completely covers the impression (22), and cutout (24'), and whose upper surface defines the surface form of the front face of the ceramic tile, the upper punch (3) has a coating (33) and whose lower surface defines a forming surface (30) to form the backside of the tile, said layer or coating (23) is continuous and completely covers the lateral portion of impression (22) that forms a general shape, which continues on the uppermost part, and into the cutout (24') the layer 23 having a horizontal edge (23') turned toward the exterior with respect to the impression (22) in the cutout (24'), on an upper lateral surface (24) of the body (21) of the punch (2), a rigid part (11) is provided, in contact with the upper lateral (24) of the body (21) of the punch, to clamp the horizontal edge (23') in the cutout (24') against the surface (24) of the body (21) of the punch, comprising the steps of:

placing ceramic material to be formed in said lower punch (2), placing said upper punch (3) on top of said ceramic material, and applying pressure to said upper punch (3) to compact the material and form said ceramic tile.

* * * * *